United States Patent [19]

Garman

[11] Patent Number: 4,768,917

[45] Date of Patent: Sep. 6, 1988

[54] LOADER BOOM MECHANISM

[75] Inventor: Anthony L. Garman, Stevensville, Mich.

[73] Assignee: VME Americas Inc., Cleveland, Ohio

[21] Appl. No.: 922,402

[22] Filed: Oct. 23, 1986

[51] Int. Cl.[4] ..... B66C 23/00; B66F 9/00

[52] U.S. Cl. ..... 414/697; 414/701; 414/708; 414/713

[58] Field of Search ..... 414/713, 697, 700, 706, 414/707, 708, 716, 701

[56] References Cited

U.S. PATENT DOCUMENTS

| | | | |
|---|---|---|---|
| 2,590,454 | 3/1952 | Pilch | 91/420 |
| 2,753,059 | 7/1956 | Pilch | 414/713 |
| 2,807,379 | 9/1957 | Pilch | 414/713 X |
| 2,817,448 | 12/1957 | Pilch | 414/713 |
| 3,411,647 | 11/1968 | Zimmerman | 414/707 |
| 3,648,871 | 3/1972 | Layton | 414/697 X |
| 3,658,202 | 4/1972 | Peterson | 414/707 |
| 4,156,488 | 5/1979 | Stark | 414/697 |
| 4,163,498 | 8/1979 | Grooss et al. | 414/697 |
| 4,239,444 | 12/1980 | Schmelzer | 414/697 X |
| 4,431,364 | 2/1984 | Redenbarger et al. | 414/706 X |

FOREIGN PATENT DOCUMENTS

| | | |
|---|---|---|
| 0962232 | 2/1975 | Canada . |
| 0183779 | 3/1963 | Sweden . |
| 0753209 | 7/1956 | United Kingdom . |

OTHER PUBLICATIONS

Terex 72-11 Loader Brochure dated Jun. 1971.

*Primary Examiner*—Robert J. Spar
*Assistant Examiner*—Jennifer L. Doyle
*Attorney, Agent, or Firm*—Watts, Hoffmann, Fisher & Heinke Co.

[57] ABSTRACT

A boom mechanism including a linkage which interconnects the frame of a loader with the boom arm and the loader bucket. The linkage includes a cross-shaped member having arms extending forwardly, rearwardly and laterally. The rearward arm is pivotally connected to a hydraulic cylinder which is pivotally connected to the frame. The forward arm is pivotally connected to the bucket. The two lateral arms are pivotally connected to a pair of push rods which are pivotally connected to the sides of the boom arm.

11 Claims, 5 Drawing Sheets

Fig. 5
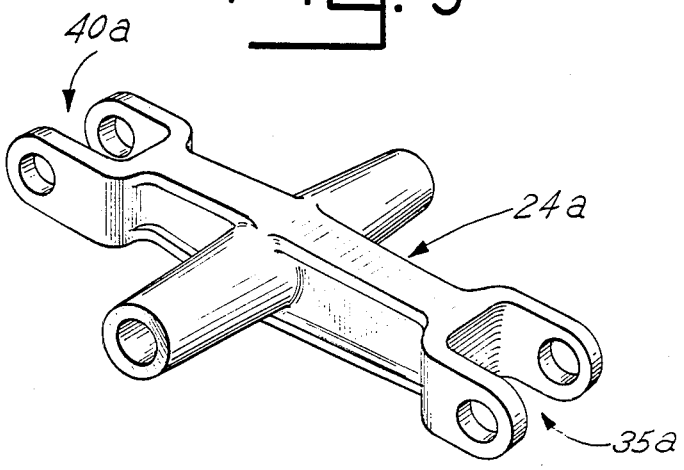
Fig. 6
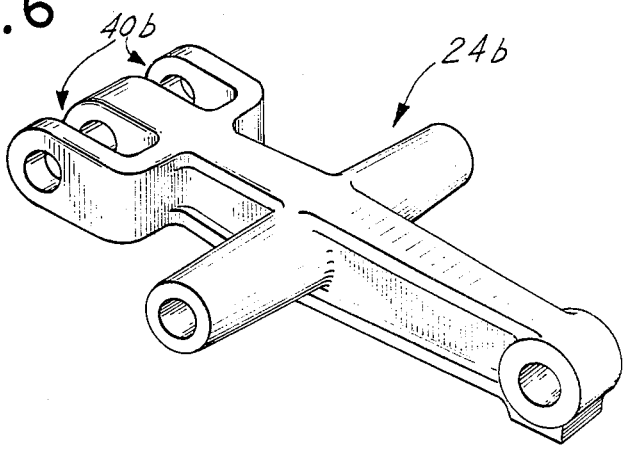
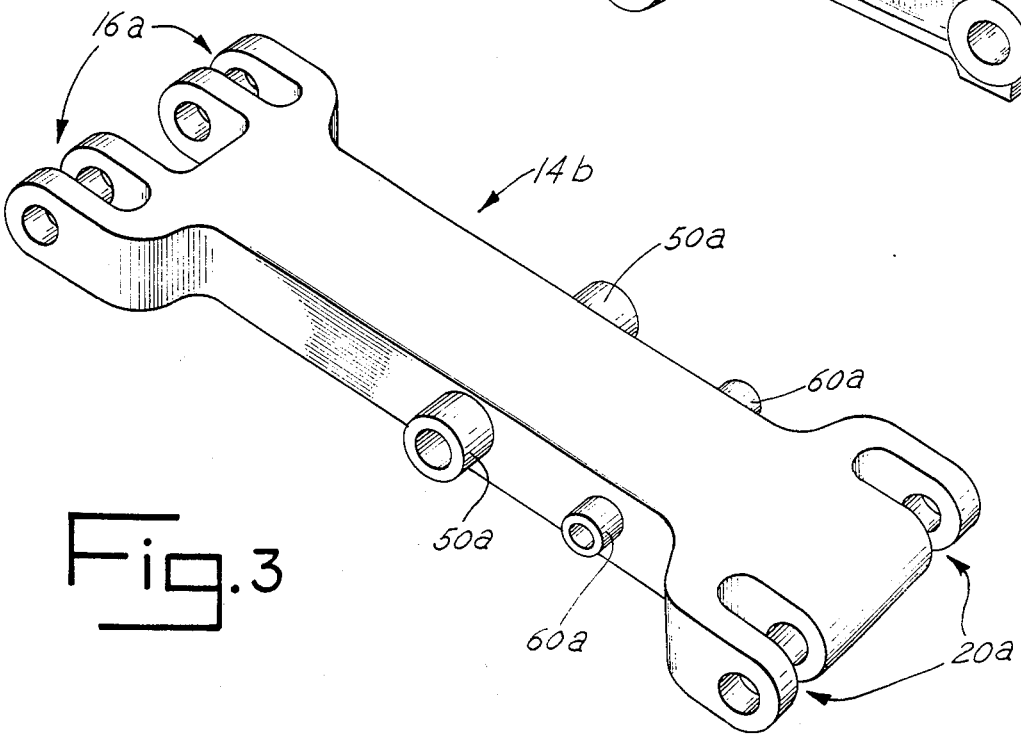
Fig. 3

LOADER BOOM MECHANISM

BACKGROUND OF THE INVENTION

1. Field of the Invention

This invention relates to a boom mechanism for an end loader and more particularly to a boom mechanism which includes a T-bar type linkage.

2. Description of the Prior Art

T-bar linkages have been known for many years. See for example U.S. Pat. Nos. 2,590,454 Pilch dated Mar. 25, 1952 and 2,753,059 Pilch dated July 3, 1956. A T-bar linkage was used on the Terex Model 72-11 Loader which was manufactured in Great Britain. A Volvo loader uses a T-bar linkage which has an extra bellcrank.

SUMMARY OF THE INVENTION

This invention comprises a boom mechanism for an end loader which has a frame, an outwardly projecting boom arm pivotally mounted on the frame to be raised and lowered and a bucket pivotally mounted at the outer end of the boom arm. A T-bar linkage interconnects the frame, through a hydraulic cylinder, with the bucket and the boom arm. The T-bar linkage includes a cross-shaped member having forwardly and rearwardly extending arms and two laterally extending arms. The rearward arm is pivotally connected to the hydraulic cylinder which is pivotally connected to the frame. The forward arm is pivotally connected to the bucket. The two lateral arms are pivotally connected to the upper ends of a pair of push rods which are pivotally connected at their lower ends to opposite sides of the boom arm respectively.

BRIEF DESCRIPTION OF THE DRAWING

FIG. 3 shows another alternate construction for the boom arm;

FIG. 5 shows a modified bellcrank;

FIG. 6 shows another form of bellcrank; and

DESCRIPTION OF THE PREFERRED EMBODIMENT

Figure 1:
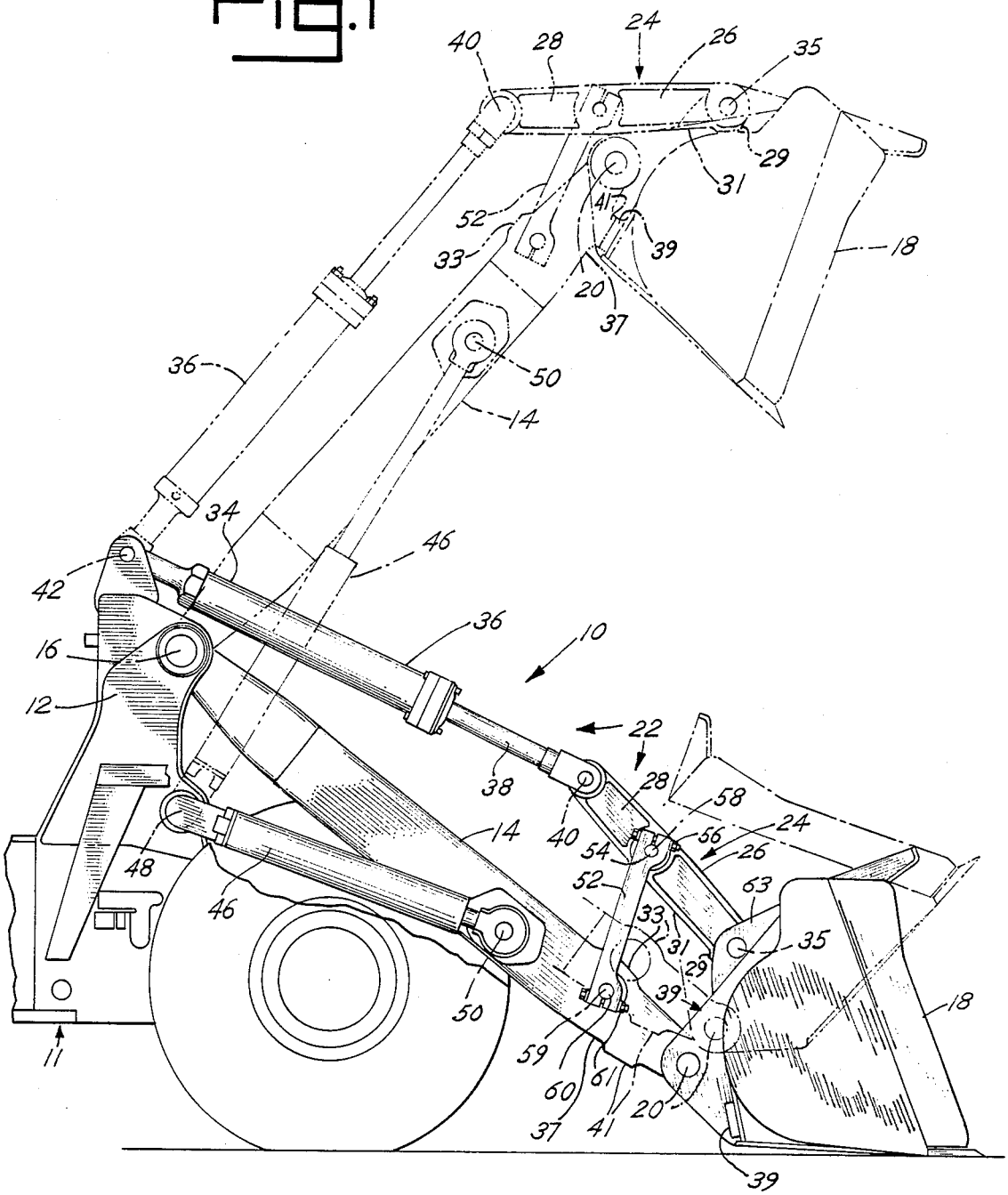
FIG. 1 of the drawing is a side elevational view of the boom mechanism of this invention.
Figure 2:
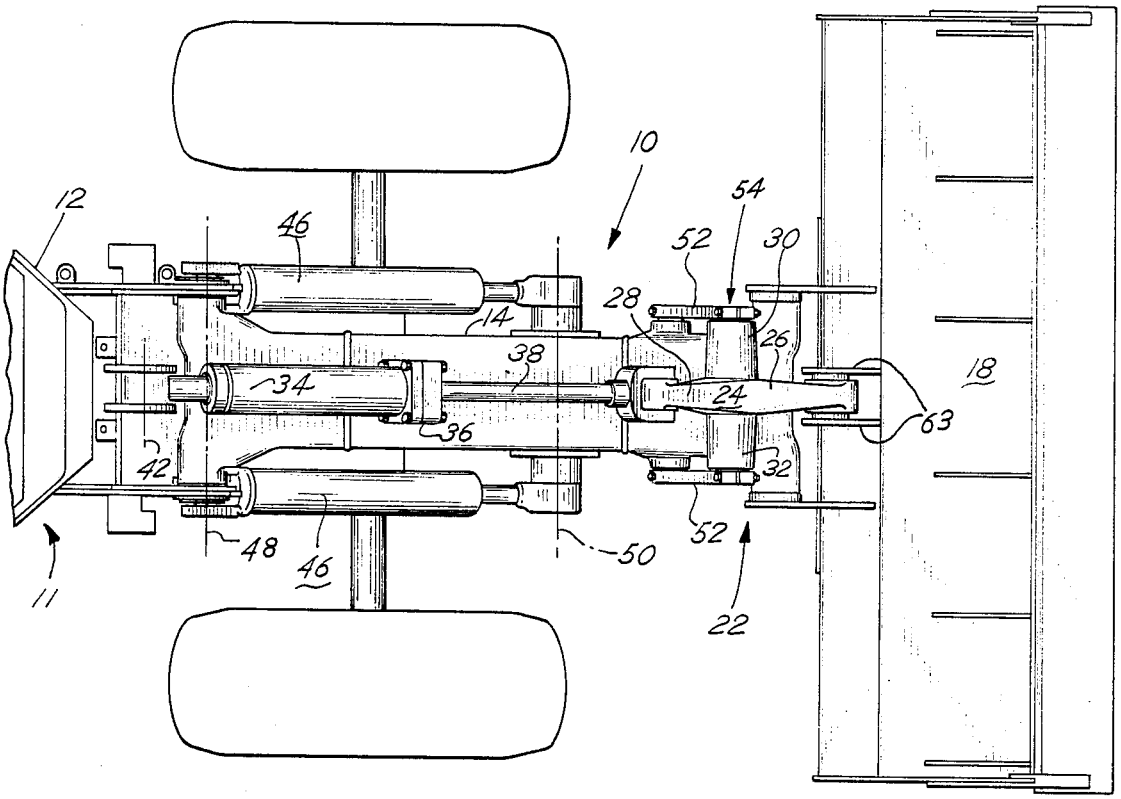
FIG. 2 is a top plan view of the boom mechanism.
Figure 4:
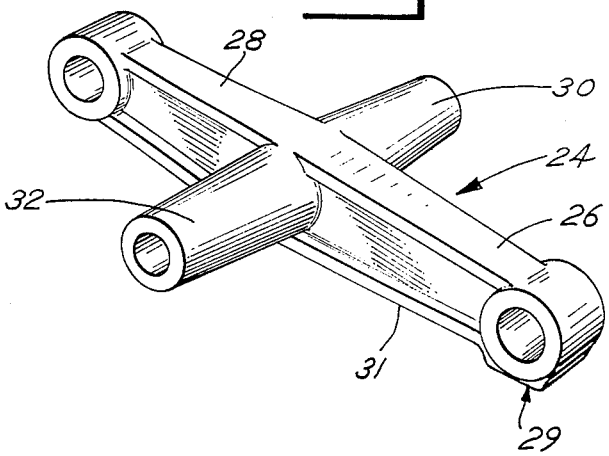
FIG. 4 is a perspective view of a bellcrank which is included in the boom mechanism.
Figure 2A:
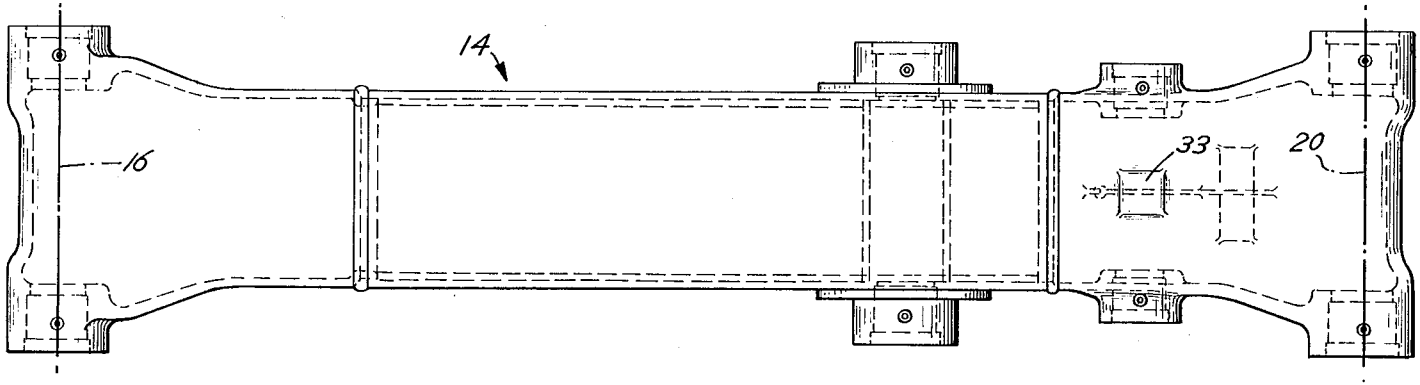
FIG. 2A is a top view of the boom arm portion only of a preferred form of the boom mechanism.
Figure 2B:
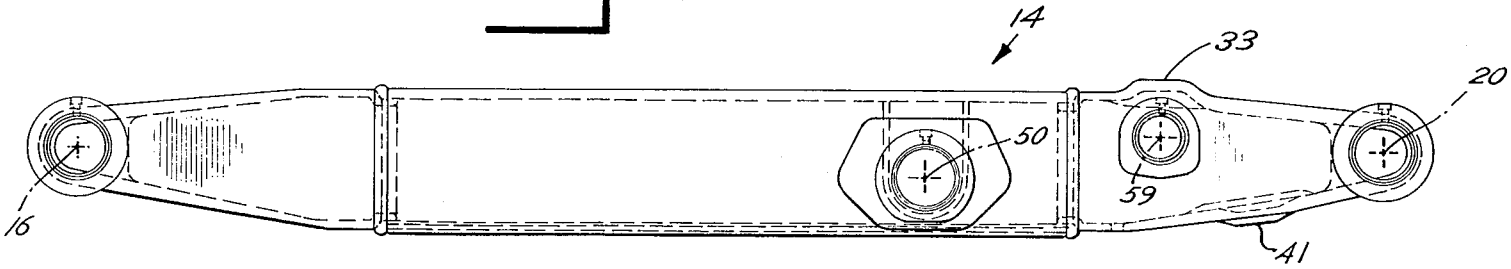
FIG. 2B is a side elevational view of the boom arm of FIG. 2A.
Figure 2C:
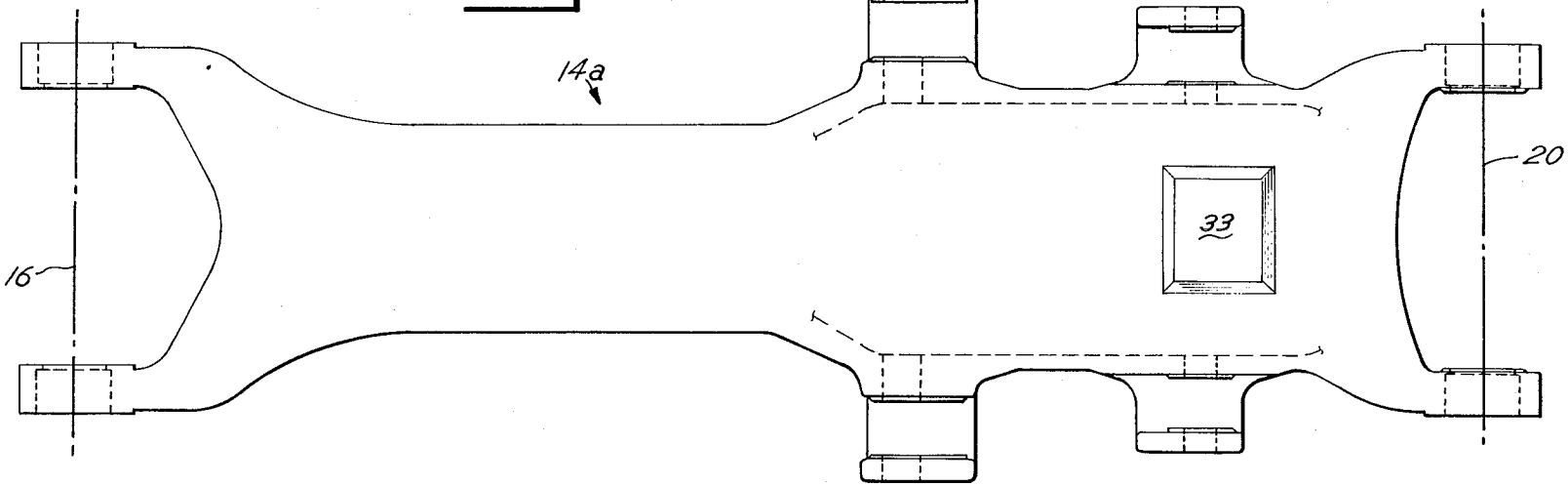
FIG. 2C is a top view of an alternate boom arm construction.
Figure 2D:
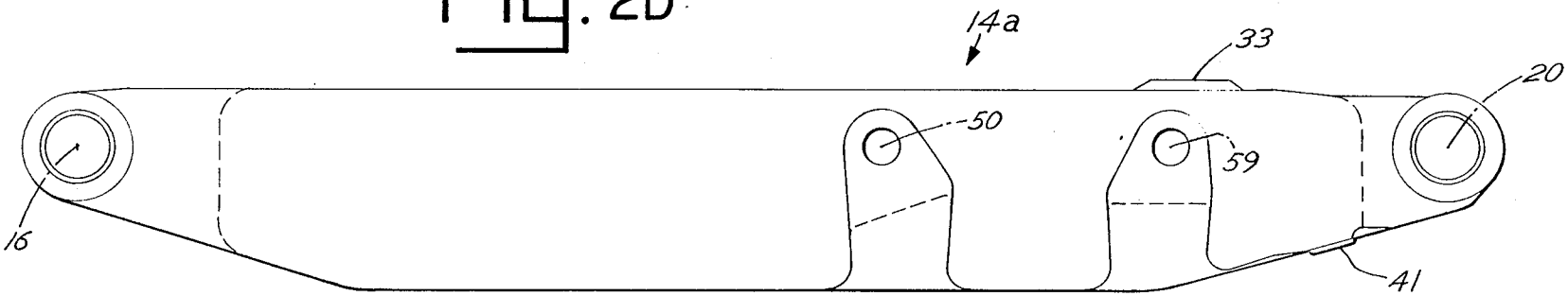
FIG. 2D is a side elevational view of the boom arm of FIG. 2C.

Referring to FIGS. 1 and 2 of the drawing, the numeral 10 indicates generally a boom mechanism in accordance with the present invention. The boom mechanism is shown on a wheel type end loader 11 having a frame 12 which may be the front frame portion of an articulated vehicle. Included in the boom mechanism is a forwardly projecting boom arm 14 pivotally mounted on frame 12 to pivot about an axis 16 and a bucket 18 pivotally mounted at the outer end of the boom arm for pivotal movement about axis 20. A T-bar linkage indicated generally by the numeral 22 interconnects the frame 12 with the bucket 18 and the boom arm 14. The linkage 22 comprises a unitary cross-shaped bellcrank 24 which includes a forward arm 26, a rearward arm 28 and lateral arms 30 and 32. FIGS. 2 and 4 show the cross-shaped configuration of bellcrank 24. The forward arm 26 of bellcrank 24 is pivotally connected to bucket 18 to pivot about axis 35. Rearward arm 28 is pivotally connected to frame 12 by means of an intermediate hydraulic cylinder 36. The head end 34 of cylinder 36 is connected to the frame 12 to pivot about axis 42, while the rod 38 is pivotally connected to bellcrank 24 to pivot about axis 40. FIGS. 2A and 2B show respectively top and side views of boom arm 14; while FIGS. 2C and 2D show top and side views of an alternate boom construction 14*a;* and FIG. 3 shows another alternate construction 14*b* for the boom arm.

The boom arm 14 is raised and lowered by means of a pair of hydraulic cylinders 46, one on each side of the vehicle. The head ends of cylinders 46 are pivotally connected to the frame 12 to pivot about axis 48. The rod ends of cylinders 46 are pivotally connected to boom arm 14 to pivot about axis 50. The boom arm illustrated is a hollow unitary structure made up of two end castings connected together by a welded midsection with the midsection welded to the end castings; and this applies to all three forms of the boom arm which are illustrated herein. However the boom arm can be made entirely by welding or as a single casting. As shown the center portion of the boom is rectangular in section, however, it can be square, circular, elliptical or other configuration. The construction of the present invention, with the push rods pivotally connected to the sides of the single boom arm, maximizes the strength of the boom arm because it has a minimum number of openings through or into the boom arm. At the same time the present invention minimizes the extent to which the boom arm and appendages interfere with the operator's visibility of the bucket because of the relatively small size of the boom arm and the small sizes and quantities of related parts.

The bellcrank 24 and the boom arm 14 are interconnected by a pair of push rods 52 one on each side of the T-bar linkage. As illustrated each of the push rods 52 is pivotally connected about axis 58 to the bellcrank 24 by means of a single pivot pin 54 which extends entirely through the lateral arms 30 and 32 of bellcrank 24. See FIGS. 1, 2 and 4. The push rods 52 are secured to transverse pin 54 by nut and bolt connectors 56 which secure both push rods firmly to transverse pin 54 on which bellcrank 24 is pivotally mounted. It will be understood that other equivalent connections such as bolting the push rods directly to the pin 54 or using flagged pins may be employed instead of connectors 56 if desired. The push rod construction described and illustrated in FIG. 1 is reproduced in mirror image on the other side of the T-bar linkage as indicated by FIG. 2. The lower ends of push rods 52 are secured at 61 to the outer ends of a pin 60 which extends through boom arm 14, to pivot about axis 59.

Figure 7:
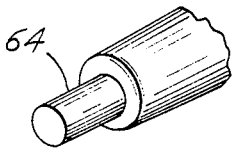
FIG. 7 shows an alternate construction for a portion of the bellcrank.

As shown the pins 54 and 60 extend entirely through the bellcrank and the boom arm respectively. An alternate construction for the lateral arms 30 and 32 of the bellcrank is illustrated in FIG. 7 in which a dead shaft 64 extends cantilever fashion from the end of each lateral arm instead of a single shaft extending entirely through the bellcrank; and the push rods 52 are pivotally mounted on the respective dead shafts.

FIG. 4 shows a perspective view of the bellcrank 24 in the form originally discussed. If desired this bellcrank can be modified to the form 24*a* illustrated in FIG. 5 which is equipped with clevis connections 35*a* and 40*a* at the respective ends of the forward arm and the rearward arm for connection to the bucket 18 and bucket cylinder 36 respectively.

FIG. 6 of the drawing illustrates another form 24*b* for the bellcrank having a double clevis 40*b* at the rearward end of the bellcrank. This is to accommodate two bucket cylinders side-by-side.

FIG. 3 of the drawing shows an alternate construction 14*b* for the boom arm which includes double clevis connections 16*a* and 20*a* at the rearward end and the forward end respectively of the boom member. FIG. 3 also shows bosses 50*a* and 60*a* respectively on the sides of the boom arm 14*a*. The bosses provide greater strength for the respective pivot joints by which the forward ends of hydraulic lift cylinders 46 and the lower ends of push rods 52 respectively are connected to the boom arm.

A feature of this T-bar linkage is that contact point 29 on the lower surface 31 of the forward arm 26 of the bellcrank provides a roll-back stop for bucket 18. When the bucket is pivoted rearwardly to a load carry position indicated by dash-dot lines in FIG. 1 projection 33 on the boom arm 14 contacts the lower surface 31 of the bellcrank at contact point 29 and prevents further pivotal movement. If the FIG. 5 embodiment of the T-bar is used one of the ribs 63 on the bucket (see FIG. 2) is used to contact location 33 to provide the bucket rollback stop.

Projection 41 on the lower surface 37 of boom arm 14 provides a dump stop for the bucket 18; projection 39 on the bucket contacts location 41 on the boom arm when the bucket is in the elevated dump position illustrated by the dash double dot lines in FIG. 1. Both the dump and rollback stop arrangements have the advantage that there is only one surface or location on each abutting part which makes contact. Therefore such parts do not have to be machined or set individually.

In operation the boom mechanism 10 may be moved from the loading position illustrated in solid lines in FIG. 1 to the carry position which is accomplished by extending hydraulic cylinders 46 a small amount and at the same time rolling back bucket 18 to the carry position by retracting hydraulic cylinder 36. In the carry position projection 29 on bellcrank 24 (see FIG. 4) contacts projection 33 on the boom arm 14. The load in the bucket may then be transported to another location where it is to be discharged from the loader. At the latter location the boom arm 14 is pivoted upwardly by extension of hydraulic cylinders 46. At the elevated dumping position the bucket 18 is put in the dump position illustrated in dash double dot lines in FIG. 1 for dumping the load from the bucket, by extending cylinder 36. In this position projection 39 on the bucket contacts the boom arm 14 at projection 41 on the underside of the boom arm. After the dumping procedure the boom arm mechanism may be restored to a transport position by retracting hydraulic cylinders 46 and retracting hydraulic cylinder 36.

The linkage of this boom arm mechanism is referred to as a T-bar linkage because of the relationship of bellcrank 24 and push rods 52 as illustrated in the side profile view of FIG. 1 wherein these two members are in a T-shaped configuration. Others have used T-bar linkages but none has used the novel construction of the present invention in which the bellcrank member of the T-bar linkage is cross-shaped in the top view of FIG. 2 and the push rods are connected between the ends of the lateral arms of the bellcrank and the respective sides of the boom arm 14.

While I have illustrated in FIGS. 1, 2, 2*a* and 2*b* and described the best mode contemplated for carrying out my invention it will be appreciated that modifications may be made. Accordingly it should be understood that I intend to cover by the following claims all such modifications which fall within the true spirit and scope of my invention. "Hydraulic cylinder" and "cylinder" as used herein means a double acting linear hydraulic motor comprising an outer barrel portion with both ends closed and an internal piston forming variable volume chambers between the piston and the respective ends of the barrel portion. The piston is mounted on a rod which projects through the closure at one end of the barrel portion.

I claim:

1. A boom mechanism for a loader having a frame, an outwardly projecting boom arm having outer sides and upper and lower surfaces and being pivotally mounted on the frame and located along a centerline of the loader, and a bucket pivotally mounted at the outer end of the boom arm, comprising a linkage interconnecting said boom arm with said frame and said bucket, said linkage including a cross-shaped bellcrank member having two arms, one extending forwardly and the other rearwardly and two arms extending laterally, said forward arm pivotally connected to said bucket, said rearward arm pivotally connected to a hydraulic cylinder which is pivotally connected to said frame, and a pair of push rods pivotally connected between the outer extremities of said lateral arms and the said outer sides of said boom arm respectively.

2. A boom mechanism as in claim 1 wherein said boom arm is a unitary member.

3. A boom mechanism as in claim 1 wherein said push rods are connected to the said lateral arms respectively by means of a single pivot pin which extends through both lateral arms.

4. A boom mechanism as in claim 1 wherein said push rods are connected to said lateral arms respectively by dead shafts extending cantilever fashion from the lateral arms.

5. A boom mechanism as in claim 1 wherein said boom arm has an upper contact point on its said upper surface and said bellcrank has a surface thereon which contacts said upper contact point in a carry position of the bucket.

6. A boom mechanism as in claim 1 wherein said boom arm has a lower contact point on its said lower surface and said bucket contacts said lower contact point in a dump position of said bucket.

7. A boom mechanism as in claim 1 wherein said boom member has an upper contact point on its said upper surface, said bellcrank member has a location thereon which contacts said upper contact point in a carry position of the bucket, said boom arm has a lower contact point on its said lower surface, and said bucket contacts said lower contact point in a dump position of the bucket.

8. A boom mechanism as in claim 1 wherein said boom arm has an upper contact point on its said upper surface and said bucket has a rib thereon which contacts said upper contact point in a carry position of the bucket.

9. A boom mechanism having a frame, an outwardly projecting unitary boom arm having outer sides and upper and lower surfaces and being pivotally mounted on the frame and located along a centerline line of the loader, and a bucket pivotally mounted at the other end of the boom arm, comprising:

a linkage interconnecting said boom arm with said frame and said bucket, said linkage including a cross-shaped bellcrank member having two arms, one extending forwardly and the other rearwardly, and two arms laterally extending, said forward arm being pivotally connected to said bucket, said rearward arm being pivotally connected to a hydraulic cylinder, the cylinder being pivotally connected to said frame, a pair of push rods respectively pivotally connected between the outer extremities of said lateral arms and the said outer sides of said boom arm, and said boom member having an upper contact point on its said upper surface, said bellcrank member having a location which contacts that upper contact point in a carry position of the bucket, said boom arm having a lower contact point on its said lower surface, and said bucket being movable into contact with said lower contact point when moved into a dump position of the bucket.

10. A boom mechanism as in claim 9 wherein said push rods are connected to the said lateral arms respectively by means of a single pivot pin which extends through both lateral arms.

11. A boom mechanism as in claim 9 wherein said push rods are connected to said lateral arms respectively by dead shafts extending cantilever fashion from the lateral arm.

* * * * *